US008943705B2

(12) United States Patent
Wisherd et al.

(10) Patent No.: US 8,943,705 B2
(45) Date of Patent: Feb. 3, 2015

(54) DIELECTRIC DRYER DRUM

(75) Inventors: David S. Wisherd, Carmel, CA (US); John A. Eisenberg, Los Altos, CA (US); Pablo E. D'Anna, Redding, CA (US)

(73) Assignee: Cool Dry LLC, San Jose, CA (US)

( * ) Notice: Subject to any disclaimer, the term of this patent is extended or adjusted under 35 U.S.C. 154(b) by 277 days.

(21) Appl. No.: 13/112,880

(22) Filed: May 20, 2011

(65) Prior Publication Data

US 2012/0291304 A1 Nov. 22, 2012

(51) Int. Cl.

| | |
|---|---|
| ***F26B 3/34*** | (2006.01) |
| ***H05B 6/10*** | (2006.01) |
| ***F26B 11/04*** | (2006.01) |
| *D06F 58/26* | (2006.01) |

(52) U.S. Cl.

CPC ..... *F26B 3/343* (2013.01); *F26B 11/0495* (2013.01); *D06F 58/266* (2013.01)

USPC ..... 34/255; 34/261; 219/629

(58) Field of Classification Search

USPC ..... 34/255, 258, 528, 259, 245–247, 250, 34/254, 256, 260–265; 219/629–632, 635, 219/643

See application file for complete search history.

(56) References Cited

U.S. PATENT DOCUMENTS

| | | | | |
|---|---|---|---|---|
| 2,472,193 | A * | 6/1949 | Clayton | 34/257 |
| 2,511,839 | A * | 6/1950 | Frye | 34/255 |
| 3,866,255 | A * | 2/1975 | Serota | 34/255 |
| 3,938,260 | A * | 2/1976 | Brenner et al. | 34/108 |
| 4,126,563 | A | 11/1978 | Barker | |
| 4,250,628 | A | 2/1981 | Smith et al. | |
| 5,463,821 | A * | 11/1995 | Gauer | 34/261 |

(Continued)

FOREIGN PATENT DOCUMENTS

| | | |
|---|---|---|
| EP | 0 862 218 A1 | 9/1998 |
| EP | 1 753 265 A1 | 2/2007 |

(Continued)

OTHER PUBLICATIONS

Wilson et al., Radio-Frequency Dielectric Heating in Industry, Thermo Energy Corporation, Report [online], Mar. 1987. Retrieved from Internet: <URL: http://infohouse.p2ric.org/ref/39/38699.pdf.

(Continued)

*Primary Examiner* — Kenneth Rinehart
*Assistant Examiner* — John McCormack
(74) *Attorney, Agent, or Firm* — Edward J. Radlo; Radlo IP Law Group

(57) ABSTRACT

A method for heating an object having a variable weight that includes a medium is provided. The method comprises: (A) placing the object having the variable weight including medium into an enclosure; (B) initiating a heating process by subjecting medium including the object having the variable weight to a variable AC electrical field; and (C) controlling the heating process. The object has substantially absorbed medium in a first "cool" state and therefore includes a maximum weight in the first "cool" state due to absorption of medium. The object is substantially free from medium in a second "heated" state due to substantial release of medium from the object, wherein the released medium is evaporated during the heating process. The heating process is completed when the object is substantially transitioned into the second "heated" state. The method further comprises using an air flow having an ambient temperature inside the enclosure to carry away the evaporated medium from the enclosure.

16 Claims, 7 Drawing Sheets

(56) References Cited

U.S. PATENT DOCUMENTS

| | | | | |
|---|---|---|---|---|
| 5,712,469 | A | 1/1998 | Chaffin et al. | |
| 5,869,817 | A | 2/1999 | Zietlow et al. | |
| 5,983,520 | A | 11/1999 | Kim et al. | |
| 6,124,624 | A * | 9/2000 | Van Roosmalen et al. | 257/531 |
| 6,141,634 | A | 10/2000 | Flint et al. | |
| 6,344,638 | B1 | 2/2002 | Tomasello | |
| 6,417,499 | B2 | 7/2002 | Blaker et al. | |
| 6,423,955 | B1 | 7/2002 | Blaker et al. | |
| 6,657,173 | B2 | 12/2003 | Flugstad et al. | |
| 6,825,618 | B2 | 11/2004 | Pu et al. | |
| 6,914,226 | B2 | 7/2005 | Ottaway | |
| 6,971,189 | B1 | 12/2005 | Anibas | |
| 7,034,266 | B1 | 4/2006 | DeGroot et al. | |
| 7,325,330 | B2 | 2/2008 | Kim et al. | |
| 7,380,423 | B1 | 6/2008 | Musone | |
| 7,933,733 | B2 | 4/2011 | Ashrafzadeh et al. | |
| 8,035,255 | B2 | 10/2011 | Kurs et al. | |
| 8,058,588 | B2 | 11/2011 | Gagas et al. | |
| 8,215,133 | B2 * | 7/2012 | Kim et al. | 68/5 C |
| 8,405,467 | B2 * | 3/2013 | He | 333/32 |
| 2004/0031731 | A1 | 2/2004 | Honeycutt et al. | |
| 2006/0109327 | A1 | 5/2006 | Diamond et al. | |
| 2007/0045307 | A1 * | 3/2007 | Tsui et al. | 219/775 |
| 2007/0163144 | A1 | 7/2007 | Dittmer et al. | |
| 2007/0271814 | A1 | 11/2007 | Bae et al. | |
| 2009/0236334 | A1 | 9/2009 | Ben-Shmuel et al. | |
| 2010/0115785 | A1 * | 5/2010 | Ben-Shmuel et al. | 34/260 |
| 2011/0067186 | A1 * | 3/2011 | Johansson | 8/137 |
| 2012/0096737 | A1 | 4/2012 | Kmet et al. | |

FOREIGN PATENT DOCUMENTS

| | | | |
|---|---|---|---|
| GB | 835454 | A | 5/1960 |
| WO | 03/019985 | A1 | 3/2003 |

OTHER PUBLICATIONS

U.S. Appl. No. 12/803,089, Office Action dated Mar. 7, 2013.
U.S. Appl. No. 12/803,089: Office Action dated Oct. 25, 2013.
U.S. Appl. No. 12/957,401: Office Action dated Oct. 25, 2013.
International Search Report (ISA/US) mailed Sep. 15, 2011 for international patent application PCT/US2011/038594 filed May 31, 2011, 3 pages.
Written Opinion of the International Searching Authority (ISA/US) mailed Sep. 15, 2011 for international patent application PCT/US2011/038594 filed May 31, 2011, 15 pages.
International Search Report (ISA/US) mailed Aug. 3, 2012 for international patent application PCT/U32012/033900 filed Apr. 17, 2012, 4 pages.
Written Opinion of the International Searching Authority (ISA/US) mailed Aug. 3, 2012 for international patent application PCT/U32012/033900 filed Apr. 17, 2012, 6 pages.
International Search Report (ISA/US) mailed Jan. 25, 2013 for international patent application PCT/US2012/061736 filed Oct. 24, 3 pages.
Written Opinion of the International Searching Authority (ISA/US) mailed Jan. 25, 2013 for international patent application PCT/US2012/061736 filed Oct. 24, 2012, 5 pages.
"Specification sheet for 1 KW Class E Module PRF-1150 power module, © 2002 Directed Energy, Inc., downloaded on Mar. 17, 2014 from: http://ixys.com/SearchResults.aspx?search=class+E&SearchSubmit=Go, 17 pages".

* cited by examiner

- The water resistance rises as the load dries
- The load impedance (Z) is dependent on:
  - Load size
  - Water content
  - Fabric types
  - Physical shape and volume

DIELECTRIC DRYER DRUM

TECHNICAL FIELD

The technology relates to the field of Radio Frequency (RF) heating systems.

BACKGROUND

Conventional clothes dryers heat a large volume of air that then passes over tumbling clothes. Water is extracted from the wet clothes by evaporation into the heated air. This conventional drying process is extremely inefficient, as at least 85% of the energy consumed by the machine goes out the vent.

The stated above inefficiency of conventional drying process is due to the fact that air is a very poor heat conductor. Thus, for example, only very small engines can be air cooled efficiently. On the other hand, some large engines, for example, an automobile engine, or a high power motorcycle engine, use water cooling because water is much better heat conductor than air.

SUMMARY

This Summary is provided to introduce a selection of concepts that are further described below in the Detailed Description. This Summary is not intended to identify key or essential features of the claimed subject matter, nor is it intended to be used as an aid in determining the scope of the claimed subject matter.

A method for heating an object having a variable weight that includes a medium is provided. The method comprises: (A) placing the object having the variable weight including medium into an enclosure; (B) initiating a heating process by subjecting medium including the object having the variable weight to a variable AC electrical field; and (C) controlling the heating process.

The object has substantially absorbed medium in a first "cool" state and therefore includes a maximum weight in the first "cool" state due to absorption of medium.

The object is substantially free from medium in a second "heated" state due to substantial release of medium from the object, wherein the released medium is evaporated during the heating process. The heating process is completed when the object is substantially transitioned into the second "heated" state.

The method further comprises using an air flow having an ambient temperature inside the enclosure to carry away the evaporated medium from the enclosure.

DESCRIPTION OF THE DRAWINGS

The accompanying drawings, which are incorporated in and form a part of this specification, illustrate embodiments of the technology and, together with the description, serve to explain the principles below.

DETAILED DESCRIPTION

Reference now is made in detail to the embodiments of the technology, examples of which are illustrated in the accompanying drawings. While the present technology will be described in conjunction with the various embodiments, it will be understood that they are not intended to limit the present technology to these embodiments. On the contrary, the present technology is intended to cover alternatives, modifications and equivalents, which may be included within the spirit and scope of the various embodiments as defined by the appended claims.

Furthermore, in the following detailed description, numerous specific-details are set forth in order to provide a thorough understanding of the presented embodiments. However, it will be obvious to one of ordinary skill in the art that the presented embodiments may be practiced without these specific details. In other instances, well known methods, procedures, components, and circuits have not been described in detail as not to unnecessarily obscure aspects of the presented embodiments.

Figure 1:
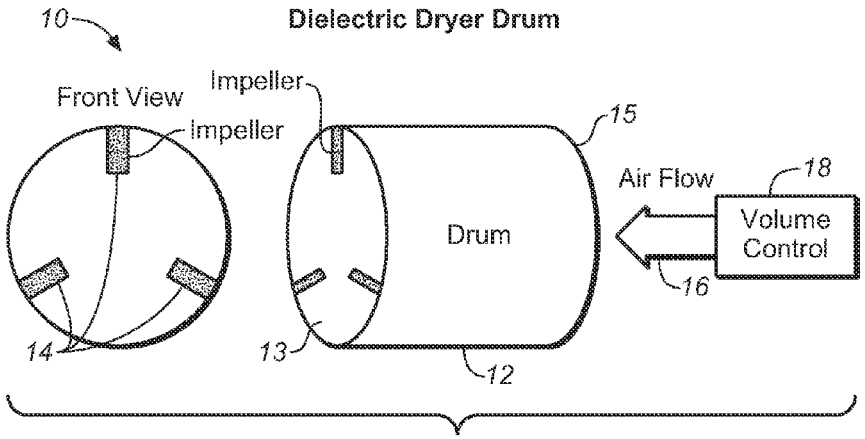
FIG. 1 illustrates a general diagram of a dielectric dryer drum for the purposes of the present technology.

In an embodiment of the present technology, FIG. 1 illustrates a general diagram 10 of a dielectric dryer drum 12 for the purposes of the present technology. This represents a new way to introduce the RF power into the dryer chamber.

In an embodiment of the present technology, more specifically, the cylindrical drum 12 having two round cathode plate ends 13 and 15 includes at least three impellors 14 utilized to introduce the RF power (please, see discussion below). An air flow 16 is used to efficiently carry out the evaporated water off the system.

In an embodiment of the present technology, the volume control block 18 is employed for controlling an air flow rate to facilitate removal of evaporated water from the drum 12.

In an embodiment of the present technology, an air path is controlled by selecting an element design (from the group consisting of: an intake air duct design (not shown), an air chamber design (not shown), and a drum impellor design (see discussion below). The element design is configured to facilitate removal of evaporated water from the drum 12.

Essentially this new way to introduce the RF into the chamber allows us to maintain the size and volume of the chamber constant, without moving parts inside. Also, the tuning out of the reactive component of the load could be accomplished by turning on or off, all or some of the impellor vanes inside the drum.

In an embodiment of the present technology, referring still to FIG. 1 the impellors 14 of the dielectric dryer drum 12 now have a double function: to scramble the clothes for better exposure to the air that removes the moisture, and also to provide the RF anode connection.

In an embodiment of the present technology, more specifically, the impellors 14 of the dryer drum 12 are now used as anodes for connection to the load with variable materials (including fabrics), weight and moisture.

In an embodiment of the present technology, the load effective shape and volume is varied by the drum rotation speed & direction, drum shape and impellor design to optimize energy transfer from the RF power source to the load over the drying cycle.

For example, semispherical protrusions (not shown) could be engineered on the end plates to help put tumbling clothes into a more optimum dynamic shape for RF coupling.

Figure 2:
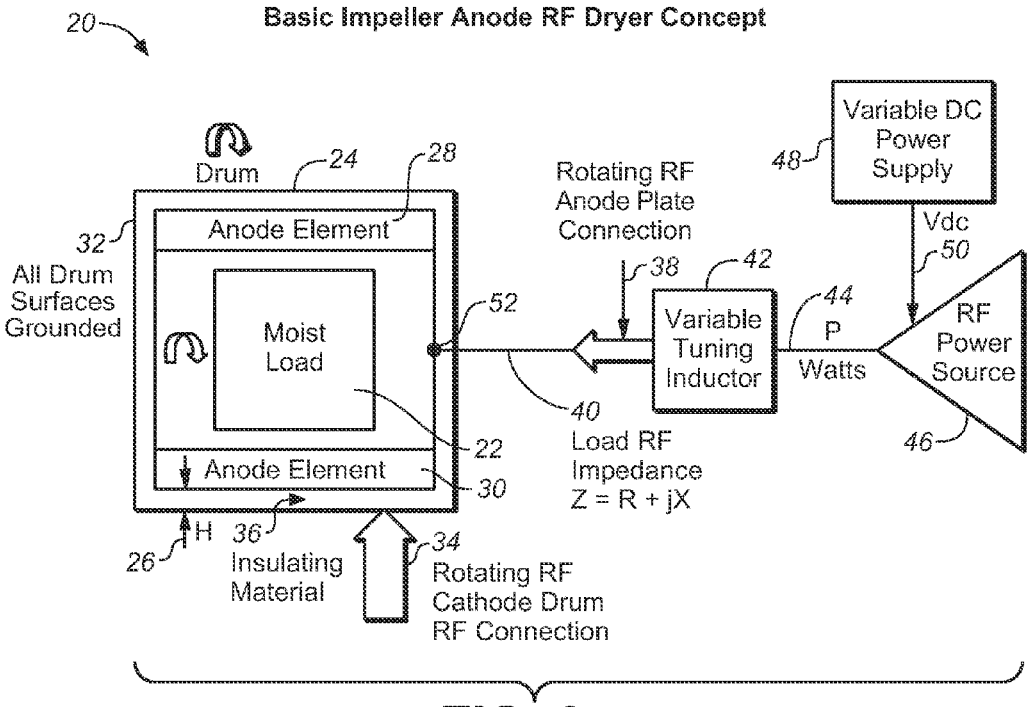
FIG. 2 shows a basic impellor anode RF dryer diagram for the purposes of the present technology.

In an embodiment of the present technology, FIG. 2 shows a basic impellor anode RF dryer diagram 20 for the purposes of the present technology.

In an embodiment of the present technology, the drum material is selected from the group consisting of: a conductor; a metal; an insulator; a dielectric insulator; a ceramic insulator; a plastic insulator; a wooden insulator; and a mixture of at least two drum materials.

In an embodiment of the present technology, an object inside the rotating drum 24 is selected from the group consisting of: a cloth substance; a food substance; a wood substance; a plastic substance; and a chemical substance.

In an embodiment of the present technology, we will focus on the object 22 comprising a moist load of clothing.

In an embodiment of the present technology, all drum surfaces are grounded 26.

In an embodiment of the present technology, each drum impellor is driven with RF energy as a "hot anode" (28, 30), with ground return being the entire drum surface 32. Each impellor is shaped and placed into the drum in a manner to maximize RF coupling to the tumbling, or stationary, load while minimizing non load coupled "parasitic" capacitance.

In an embodiment of the present technology, each anode element (28, 30) is separated from the conductive drum surface 32 by an insulating material 36.

In an embodiment of the present technology, the insulating material 36 is selected from the group consisting of: glass; plastic; and ceramic.

In an embodiment of the present technology, referring still to FIG. 2, the conductive cathode area 32 of the rotating drum 24 is connected to the ground return path of the RF power source by a connection selected from the group consisting of: a rotating capacitive connection; and a non-rotating capacitive connection.

In an embodiment of the present technology, referring still to FIG. 2, we will focus our discussion on the rotating RF cathode drum RF connection 34.

In an embodiment of the present technology, referring still to FIG. 2, at least one anode element (28, 30) is connected to the RF power source 46 by a connector comprising the rotating RF anode plate connector 38.

In an embodiment of the present technology, the rotating RF anode plate connector 38 is connected to RF Power source 46 by using a variable tuning inductor 42.

In an embodiment of the present technology, the variable tuning inductor 42 is used to achieve the RF tuning for optimum power transfer from the DC Supply voltage 48.

In an embodiment of the present technology, the drum is rotated with varying rotation speed to optimize RF coupling.

In an embodiment of the present technology, the direction of rotation of said drum is varied to optimize RF coupling by preventing bunching of the drying load.

In an embodiment of the present technology, the variable tuning inductor 42 adjusts its value to tune out the (−jX) from the load RF impedance 40, thus yielding a pure resistive load, R at the feed point 52

Figure 3:
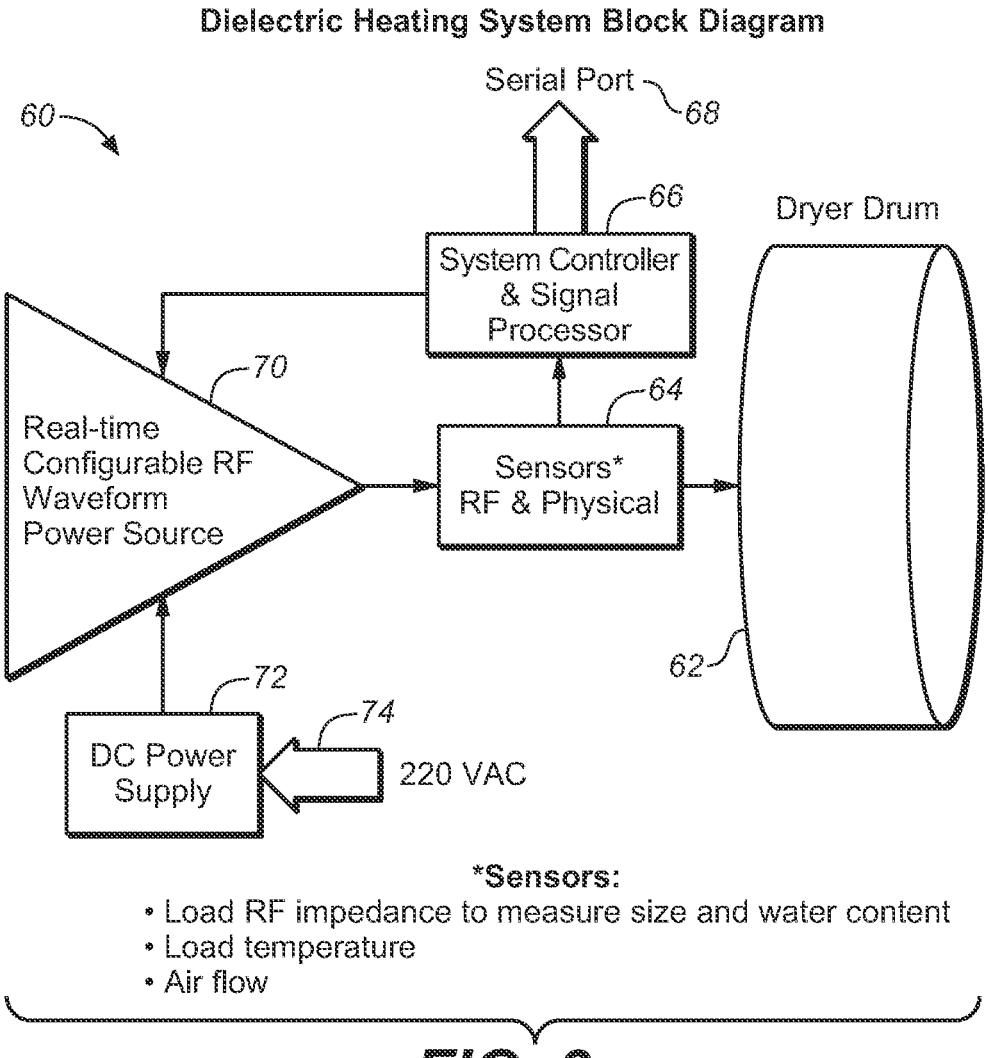
FIG. 3 depicts a dielectric heating system block diagram for the purposes of the present technology.

In an embodiment of the present technology, FIG. 3 depicts a dielectric heating system bloc diagram 60 comprising a DC power supply 72, a real time configurable RF waveform power source 70, a system controller & signal processor 66, a serial port 68, a block 64 of RF & physical sensors; and a dryer drum 62.

In an embodiment of the present technology, the heating process is controlled by selecting parameters of the real time configurable RF waveform power source 70 from the group consisting of: an applied RF voltage magnitude and envelope wave shape; an applied RF current magnitude and envelope wave shape; phase of RF voltage vs. current; voltage standing wave ratio (VSWR); and RF frequency.

In an embodiment of the present technology, the block 64 of RF & physical sensors are configured to measure the load RF impedance in order to measure the size and water content of the load, to measure the load temperature, and to measure parameters of the air flow.

In an embodiment of the present technology, the system controller & signal processor 66 is configured to control parameters of the real time configurable RF waveform power source 70 by using the real time data provided by the block 64 of RF & physical sensors.

Figure 4:
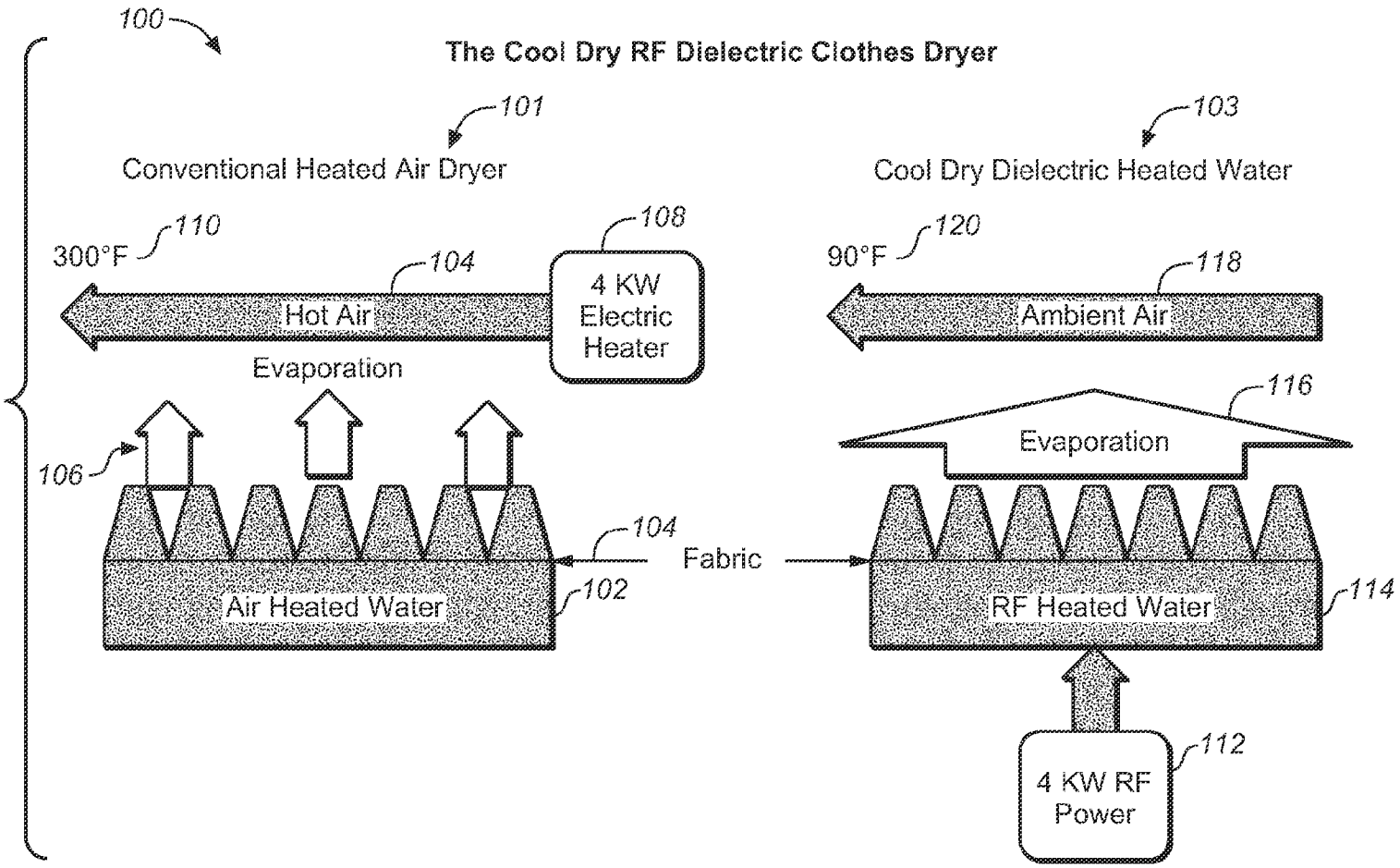
FIG. 4 illustrates the comparison between the conventional heated air dryer and the proprietary Cool Dry dielectric dryer for the purposes of the present technology.

FIG. 4 illustrates the comparison diagram 100 between the conventional heated air dryer 101 and the proprietary Cool Dry dielectric dryer 103 for the purposes of the present technology.

In the conventional heated air dryer, the 4 kW applied power 108 causes heating of the hot air 104 up to 300° F. 110 due to evaporation of RF heated water 106. Such hot temperature adversely affects the properties of the drying fabric.

On the other hand, in the proprietary Cool Dry dielectric dryer 103 the 4 kW applied RF power 112 causes evaporation of RF heated water 114 but does not cause heating of the ambient air 118 that has temperature only up to 90° F. (room temperature). Such ambient temperature does not adversely affect the properties of the drying fabric.

Figure 5:
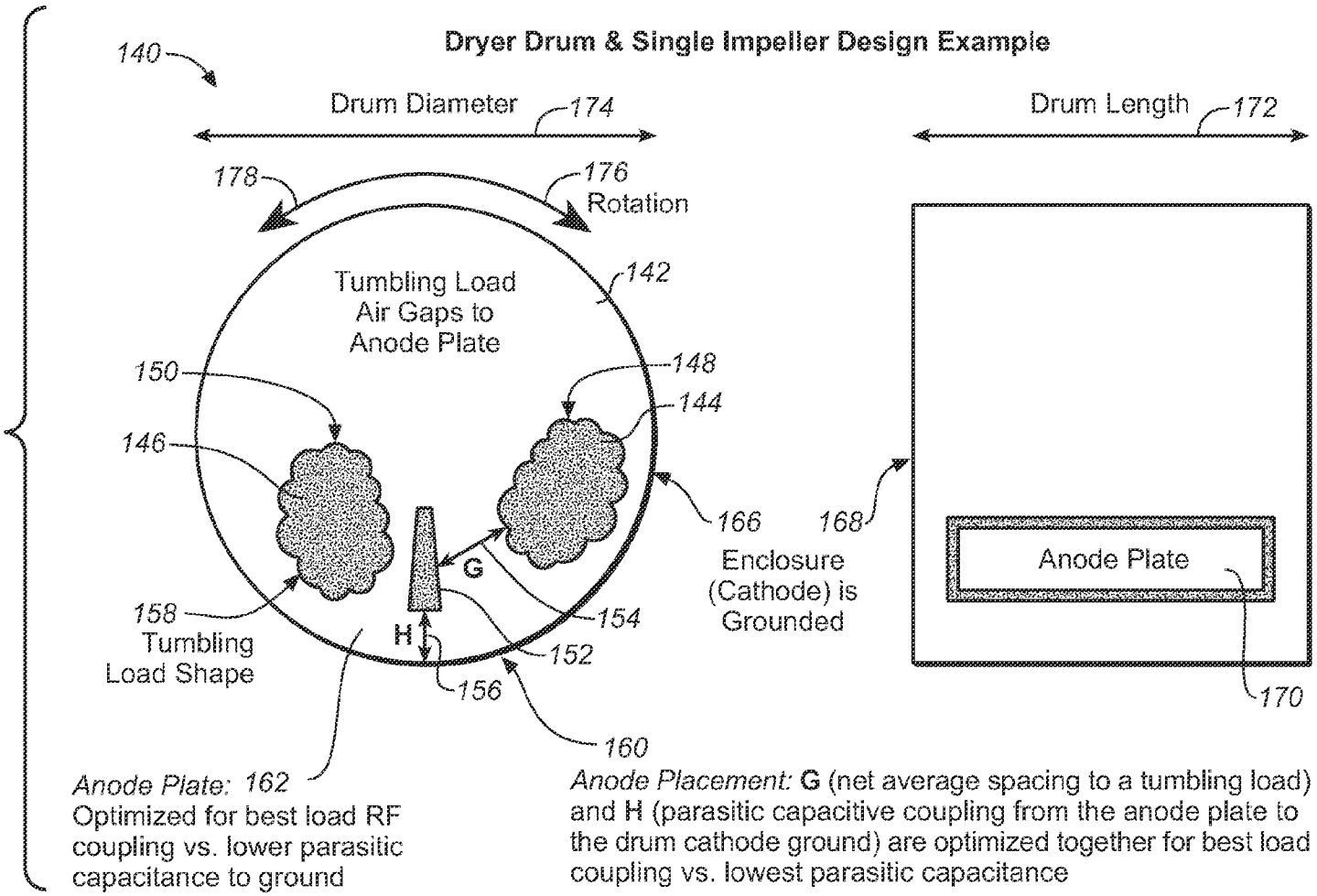
FIG. 5 shows a dryer drum and single impellor design example for the purposes of the present technology.

FIG. 5 shows a dryer drum and single impellor design example 140 for the purposes of the present technology. There are tumbling load air gaps between the tumbling loads 150 and 148 and the anode plate 162 depending on the tumbling load shape 158 and the anode shape and placement 160.

In an embodiment of the present technology, the anode plate shape is optimized for best load RF coupling vs. lower parasitic capacitance to ground.

In an embodiment of the present technology, the anode plate shape is optimized to accommodate for different kind of fabrics and different kind of load.

In an embodiment of the present technology, the anode plate placement 160 is also optimized so that the parameter G 154 (net average spacing to a tumbling load) and the parameter H 156 (parasitic capacitive coupon from the anode plate to the drum cathode ground) are optimized together for best load coupling vs. lower parasitic capacitance to ground.

In an embodiment of the present technology, the rotating RF anode plate connector 38 (of FIG. 3) is selected from the group consisting of: a brush-contact commutator; and a capacitive coupling.

In an embodiment of the present technology, the rotating RF anode plate connector 38 (of FIG. 3) comprises a capacitive coupling selected from the group consisting of: a parallel plate; and at least one concentric cylinder.

Figure 6:
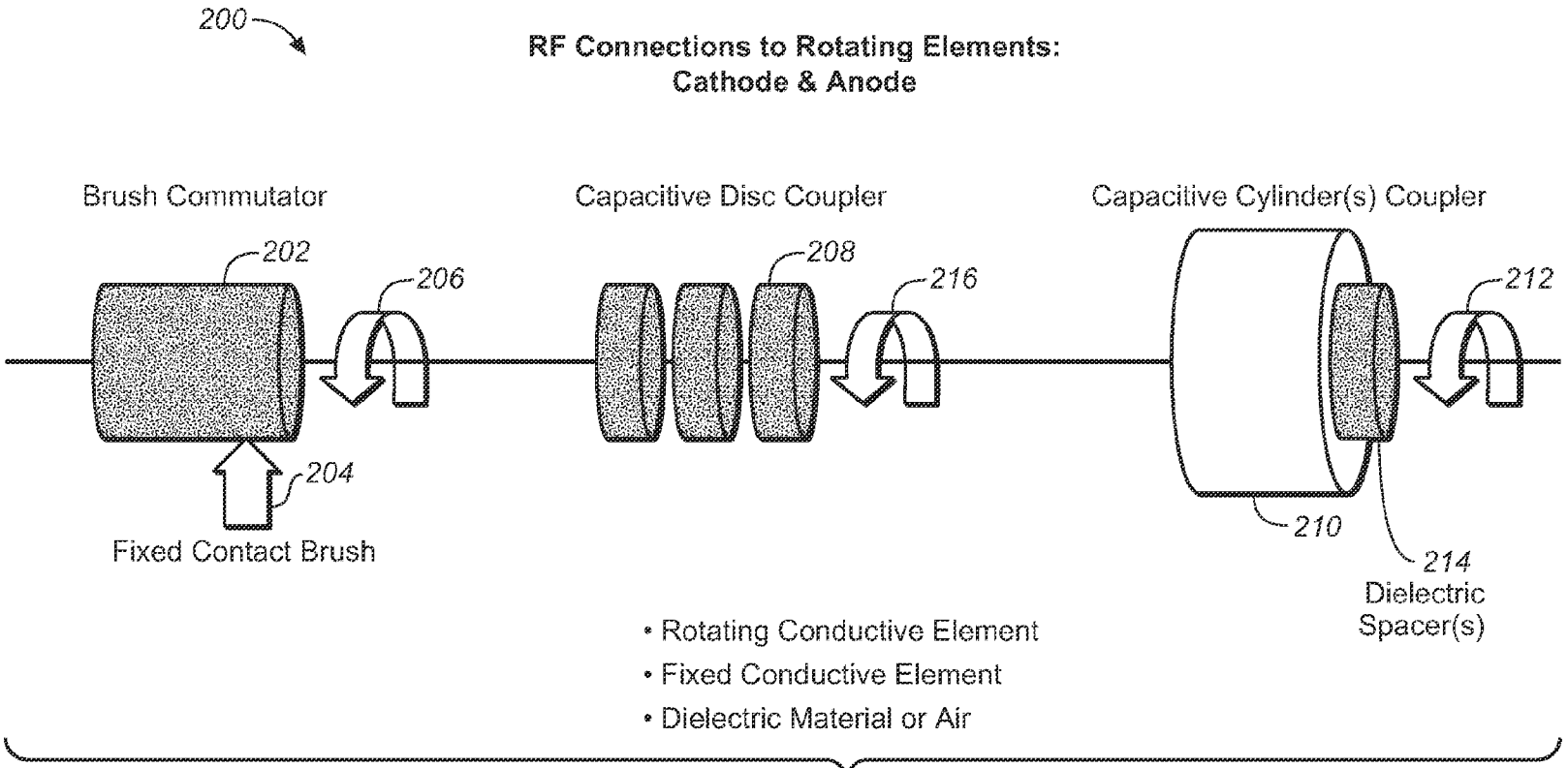
FIG. 6 depicts RF connections to rotating elements cathode & anode for the purposes of the present technology.

More specifically, FIG. 6 depicts diagram 200 of RF connections to rotating elements cathode & anode for the purposes of the present technology.

In an embodiment of the present technology, the anode plate is connected to the RF source by using a fixed contact brush (204 of FIG. 6).

In an embodiment of the present technology, the anode plate is connected to the RF source by using a rotating brush commutator (202 of FIG. 6).

In an embodiment of the present technology, the anode plate is connected to the RF source by using a capacitive disc coupler (208 of FIG. 6).

In an embodiment of the present technology, the anode plate is connected to the RF source by using at least one capacitive cylinder disc coupler (210 of FIG. 6).

Figure 7:
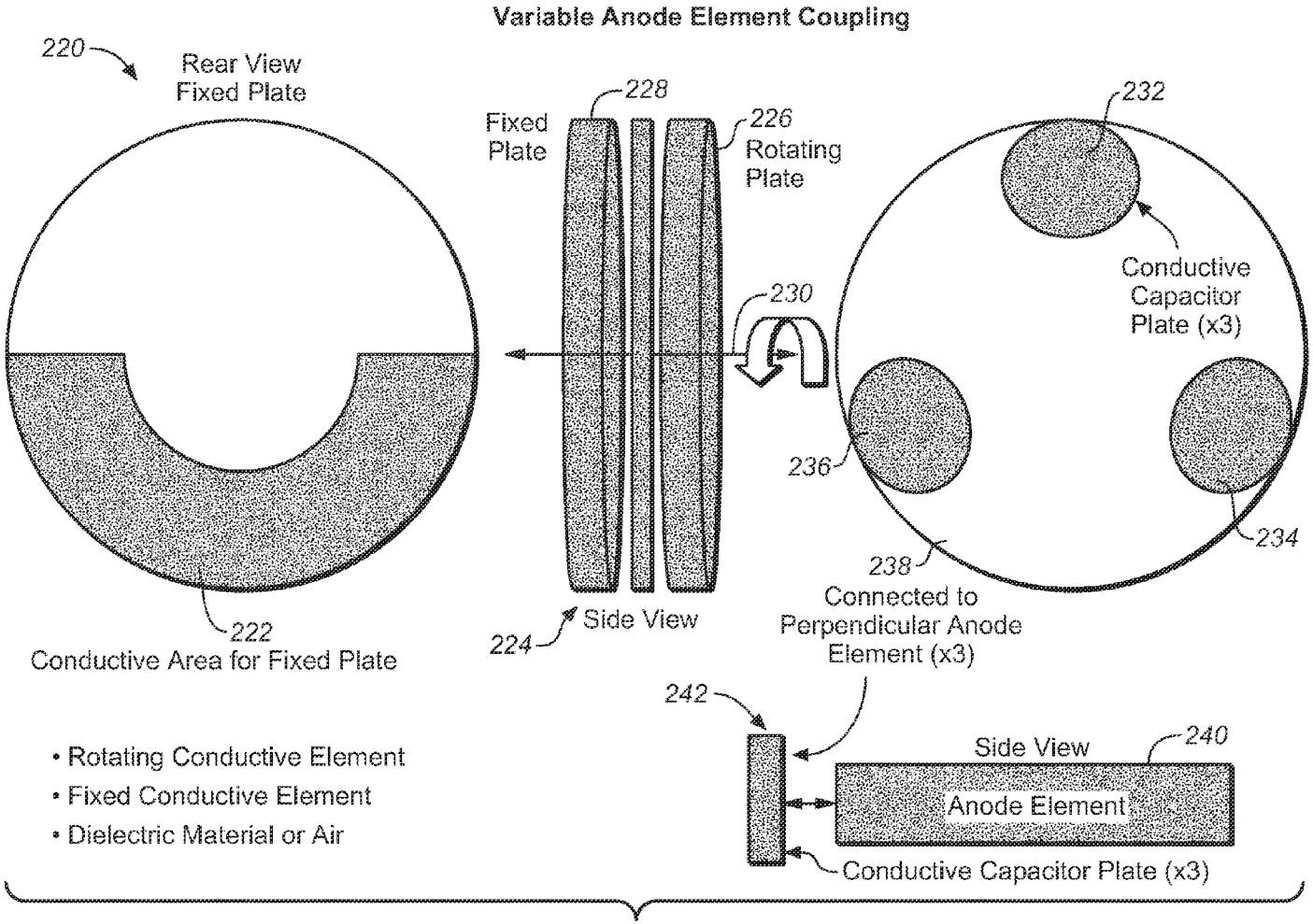
FIG. 7 illustrates variable anode element coupling for the purposes of the present technology.

FIG. 7 is a diagram 220 that illustrates variable anode element coupling for the purposes of the present technology.

In an embodiment of the present technology, the conductive area of the fixed anode plate 222 is shown in a rear view.

In an embodiment of the present technology, the fixed anode plate 228 and rotating plate 226 are shown in a side view 224.

In an embodiment of the present technology, the conductive capacitor plates 232, 234, and 236 are perpendicular (shown by legend 242) connected to the anode element 240.

Figure 8:
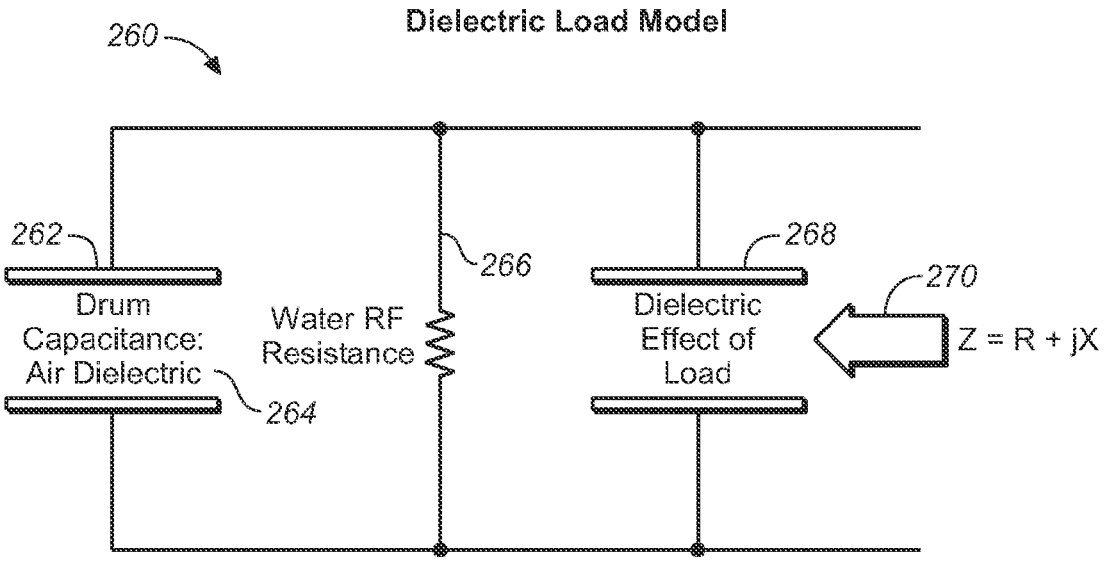
FIG. 8 shows a dielectric load model of the dielectric dryer drum for the purposes of the present technology.

FIG. 8 shows the dielectric load model 260 of the dielectric dryer drum for the purposes of the present technology.

The drum has a fundamental capacitance, 262 based on its physical dimensions and air dielectric permittivity 264. The water in the load has an RF resistance 266 related to the amount of water contained. The materials in the load add an additional capacitance 268 to the model, based on their dielectric constant >1. Thus, the load impedance 270 is:

$$Z=R+jX \quad \text{(Eq. 1)}$$

The load impedance Z is dependent on: load size, water content; fabric types, and physical shape and volume.

The basic principle is dynamically maximized RF coupling to the load resistance (water). The design optimizes the water resistance while minimizing parasitic capacitance 268.

In an embodiment of the present technology, the capacitive element of the load 268 could be minimized or perhaps totally eliminated by driving a different number of impellors with the RF source during the drying cycle. with mechanically staggered coupling capacitors.

In an embodiment of the present technology, as was disclosed above, FIG. 2 illustrates an example of the design optimization by the spacing of the impellor anode above the drum ground to minimize capacitance consistent with optimum load coupling.

In an embodiment of the present technology, the RF impedance of the load can be used to measure water content in real-time.

In an embodiment of the present technology, the method for heating an object having a variable weight that includes a medium comprises the step of placing the object having the variable weight including the medium into an enclosure; wherein the object substantially has absorbed the medium in a first "cool" state; and wherein the object includes a maximum weight in the first "cool" state due to absorption of the medium.

In an embodiment of the present technology, the method for heating an object having a variable weight that includes a medium further comprises the step of initiating a heating process by subjecting the medium including the object to a variable AC electrical field; wherein the object is substantially free from the medium in a second "heated" state due to substantial release of the medium from the object; and wherein the released medium is evaporated during the heating process.

In an embodiment of the present technology, the method for heating an object having a variable weight that includes a medium further comprises the step of controlling the heating process, wherein the heating process is completed when the object is substantially transitioned into the second "heated" state.

In an embodiment of the present technology, the method for heating an object having a variable weight that includes a medium further comprises the step of using an air flow having an ambient temperature inside the enclosure to carry away the evaporated medium from the enclosure.

In an embodiment of the present technology, wherein the enclosure comprises a dryer drum 24 version of the enclosure having at least one anode element impellor 28 (30) of variable shape, and at least one cathode area 32, and wherein the object comprises a load of clothing 22, and wherein the medium comprises water, as shown in FIG. 2, the method for heating the load of clothing 22 further comprises the step of optimally configuring the shape of at least one anode (impeller) to accommodate for different kind of fabrics and different kind of load.

In an embodiment of the present technology, wherein the enclosure comprises a dryer drum 24 version of the enclosure having at least one anode element impellor 28 (30) of variable shape, and at least one cathode area 32, and wherein the object comprises a load of clothing 22, and wherein the medium comprises water, as shown in FIG. 2, the method for heating the load of clothing 22 further comprises the step of preheating air inside the dryer drum 24 to facilitate water evaporation from the drum.

In an embodiment of the present technology, wherein the enclosure comprises a dryer drum 24 version of the enclosure having at least one anode element impellor 28 (30) of variable shape, and at least one cathode area 32, and wherein the object comprises a load of clothing 22, and wherein the medium comprises water, as shown in FIG. 2, the method for heating the load of clothing 22 further comprises the step of controlling an air flow rate by volume control block (18 of FIG. 1) to facilitate removal of evaporated water from the drum enclosure.

In an embodiment of the present technology, wherein the enclosure comprises a dryer drum 24 version of the enclosure having at least one anode element impellor 28 (30) of variable shape, and at least one cathode area 32, and wherein the object comprises a load of clothing 22, and wherein the medium comprises water, as shown in FIG. 2, the method for heating the load of clothing 22 further comprises the step of controlling an air flow path by an element design selected from the group consisting of: an intake air duct design (not shown); a chamber design (not shown); and a drum impellor design (162 of FIG. 5). The element design is configured to facilitate removal of evaporated water from the drum enclosure.

The above discussion has set forth the operation of various exemplary systems and devices, as well as various embodiments pertaining to exemplary methods of operating such systems and devices. In various embodiments, one or more steps of a method of implementation are carried out by a processor under the control of computer-readable and computer-executable instructions. Thus, in some embodiments, these methods are implemented via a computer.

In an embodiment, the computer-readable and computer-executable instructions may reside on computer useable/readable media.

Therefore, one or more operations of various embodiments may be controlled or implemented using computer-executable instructions, such as program modules, being executed by a computer. Generally, program modules include routines, programs, objects, components, data structures, etc., that perform particular tasks or implement particular abstract data types. In addition, the present technology may also be practiced in distributed computing environments where tasks are performed by remote processing devices that are linked through a communications network. In a distributed computing environment, program modules may be located in both local and remote computer-storage media including memory-storage devices.

Although specific steps of exemplary methods of implementation are disclosed herein, these steps are examples of steps that may be performed in accordance with various exemplary embodiments. That is, embodiments disclosed herein are well suited to performing various other steps or variations of the steps recited. Moreover, the steps disclosed herein may be performed in an order different than presented, and not all of the steps are necessarily performed in a particular embodiment.

Although various electronic and software based systems are discussed herein, these systems are merely examples of environments that might be utilized, and are not intended to suggest any limitation as to the scope of use or functionality of the present technology. Neither should such systems be interpreted as having any dependency or relation to any one or combination of components or functions illustrated in the disclosed examples.

Although the subject matter has been described in a language specific to structural features and/or methodological acts, the subject matter defined in the appended claims is not necessarily limited to the specific features or acts described above. Rather, the specific features and acts described above are disclosed as exemplary forms of implementing the claims.

What is claimed is:

1. A method for heating an object having a variable weight that includes a medium, said method comprising:

placing said object including said medium into an enclosure comprising a rotating drum having at least one anode element and at least one cathode area: wherein said object absorbs said medium in a first "cool" state, and said object includes a maximum weight in said first "cool" state due to absorption of said medium;

initiating a heating process by capacitively coupling said object to an AC electrical field originated from an RF power source; wherein said object including said medium transitions into a second "heated" state in which there is less medium than in said "cool" state due to release of said medium from said object; and controlling said heating process by taking real time measurements and by controlling RF parameters in real time based upon said measurements; wherein:

said heating process is completed when said object is transitioned into said second "heated" state; and said parameters are selected from the group of parameters consisting of an RF voltage magnitude and envelope wave shape, an applied RF current magnitude and envelope wave shape, phase of RF voltage versus current, and voltage standing wave ration.

2. A method for heating an object having a variable weight that includes a medium, said method comprising:

placing said object including said medium into a rotating enclosure; wherein said object absorbs said medium in a first "cool" state; and said object includes a maximum weight in said first "cool" state due to absorption of said medium;

initiating a heating process by subjecting said medium including said object to an AC electrical field originated from an RF power source; wherein said object including said medium transitions into a second "heated" state in which there is less medium than in said "cool" state due to release of said medium from said object; said rotating enclosure comprises at least one anode element and at least one cathode area; and at least one said anode element is connected to said RF power source by a connector comprising a capacitive coupling; and controlling said heating process by taking real time measurements of impedance of object, and by controlling RF parameters in real time based upon said measurements, wherein said heating process is completed when said object is transitioned into said second "heated" state.

3. A method for heating an object having a variable weight that includes a medium; said method comprising:

placing said object including said medium into a rotating enclosure; wherein said object has absorbed said medium in a first "cool" state; and said object includes a maximum weight in said first "cool" state due to absorption of said medium;

initiating a heating process by subjecting said medium including said object to an AC electrical field originated from an RF power source; wherein said object including said medium transitions into a second "heated" state in which there is less medium than in said "cool" state due to release of said medium from said object; said rotating enclosure comprises at least one anode element and at least one conductive cathode area; the object comprises a load of clothing; said medium comprises water; at least one said anode element is connected to said RF power source by a connector comprising a capacitive coupling; and said conductive cathode area of said enclosure is connected to ground by a capacitive coupling; and controlling said heating process by taking real time measurements of impedance of the object, and by controlling RF parameters in real time based upon said measurements, wherein said heating process is completed when said object is transitioned into said second "heated" state.

4. The method of claim 1 further comprising using an air flow having an ambient temperature inside said enclosure to carry away an evaporated state of said medium from said enclosure.

5. The method of claim 1, wherein said placing step further comprises:

selecting said object from the group consisting of a cloth substance; a food substance; a wood substance; a plastic substance; and a chemical substance.

6. The method of claim 1, wherein said placing step further comprises: selecting said enclosure from the group consisting of a cylindrical cathode drum having at least one impellor; and a cylindrical drum having at least one cathode end plate.

7. The method of claim 1, wherein said placing step further comprises selecting said enclosure material from the group consisting of a conductor; a metal; an insulator; a dielectric insulator; a ceramic insulator; a plastic insulator; a wooden insulator; and a mixture of at least two drum materials.

8. The method of claim 1, wherein said placing step further comprises selecting said insulating material from the group consisting of glass; plastic; and ceramic.

9. The method of claim 1, wherein said initiating step further comprises;

rotating said drum with varying rotation speed to optimize RF coupling between the RF power source and the object.

10. The method of claim 9, wherein:

the object comprises items to be dried; and said rotating comprises varying a direction of rotation of said drum to optimize RF coupling between the RF power source and the items by thwarting bunching of said items.

11. A method for heating an object having a variable weight that includes a medium, said method comprising:

placing said object having said variable weight including said medium into a rotating enclosure; wherein said object has absorbed said medium in a first "cool" state;

and wherein said object includes a maximum weight in said first "cool" state due to absorption of said medium;

initiating a heating process by subjecting said medium including said object to a variable AC electrical field introduced into the rotating enclosure by an anode located within the enclosure; wherein said object including said medium transitions into a second "heated" state in which there is less medium than in said "cool" state due to release of said medium from said object; and wherein said released medium is evaporated during said heating process;

selecting a connection from a conductive cathode area of said rotating enclosure to a ground return path of said RF power source from the group consisting of: a rotating capacitive connection; and a non rotating capacitive connection; and optimizing said heating process by at least one of adjusting spacing between the anode and the object, and optimizing parasitic capacitance between the anode and the conductive cathode area.

12. The method of claim 1 further comprising forming a connection from said cathode area to ground, said connection from the group consisting of a rotating capacitive connection and a non-rotating capacitive connection.

13. The method of claim 2 further comprising selecting said capacitive coupling from the group consisting of a parallel plate and at least one concentric cylinder.

14. The method of claim 3 further comprising minimizing a parasitic capacitance of said object including medium by mechanically staggering a plurality of coupling capacitors between at least one anode element and the RF power source.

15. The method of claim 1 wherein the measurements are from the group of measurements consisting of RF impedance of the object including the medium; temperature of the object including the medium; and parameters of air flow.

16. The method of claim 1 further comprising inserting a variable tuning inductor between the RF power source and at least one anode element; in order to optimize power transfer from the RF power source to the object including the medium.

* * * * *

UNITED STATES PATENT AND TRADEMARK OFFICE

CERTIFICATE OF CORRECTION

PATENT NO. : 8,943,705 B2
APPLICATION NO. : 13/112880
DATED : February 3, 2015
INVENTOR(S) : David S. Wisherd, John A. Eisenberg and Pablo Eugenio D'Anna It is certified that error appears in the above-identified patent and that said Letters Patent is hereby corrected as shown below:

In the Claims

In column 7, line 48
"ration." should be corrected to read --ratio.--

In column 7, line 67
"impedance of object," should be corrected to read --impedance of the object,--

In column 10, line 18
"anode element; in order" should be corrected to read --anode element, in order--

Signed and Sealed this
Twenty-eighth Day of April, 2015

Michelle K. Lee

Michelle K. Lee
*Director of the United States Patent and Trademark Office*